US010815988B2

(12) United States Patent
Buckley

(10) Patent No.: US 10,815,988 B2
(45) Date of Patent: Oct. 27, 2020

(54) FRAC PUMP SEALED NUT ASSEMBLY

(71) Applicant: ST9 Gas and Oil, LLC, The Woodlands, TX (US)

(72) Inventor: Chris Buckley, Tomball, TX (US)

(73) Assignee: ST9 GAS AND OIL, LLC, The Woodlands, TX (US)

( * ) Notice: Subject to any disclaimer, the term of this patent is extended or adjusted under 35 U.S.C. 154(b) by 153 days.

(21) Appl. No.: 15/956,684

(22) Filed: Apr. 18, 2018

(65) Prior Publication Data

US 2018/0298892 A1 Oct. 18, 2018

Related U.S. Application Data

(60) Provisional application No. 62/486,808, filed on Apr. 18, 2017.

(51) Int. Cl.

| | |
|---|---|
| ***F04B 53/00*** | (2006.01) |
| ***F04B 19/22*** | (2006.01) |
| ***F04B 53/22*** | (2006.01) |
| ***F04B 53/16*** | (2006.01) |

(52) U.S. Cl.

CPC ..... *F04B 53/00* (2013.01); *F04B 19/22* (2013.01); *F04B 53/16* (2013.01); *F04B 53/22* (2013.01); *F04B 2201/0803* (2013.01)

(58) Field of Classification Search

CPC ..... F04B 53/00; F04B 53/16; F04B 53/22; F04B 19/22; F04B 2201/0803

See application file for complete search history.

(56) References Cited

U.S. PATENT DOCUMENTS

| | | | | |
|---|---|---|---|---|
| 2,381,829 | A * | 8/1945 | Livers | F16L 19/046 285/332.3 |
| 4,498,680 | A * | 2/1985 | Schobbe | F16J 15/062 277/641 |
| 4,611,758 | A * | 9/1986 | Geberth, Jr. | B05B 15/534 239/119 |
| 5,165,731 | A * | 11/1992 | Kimuta | F16B 33/02 285/220 |
| 5,441,314 | A * | 8/1995 | Giovanni | F16L 41/10 277/641 |
| 6,236,128 | B1 * | 5/2001 | Dragash, Jr. | H02K 13/02 277/347 |
| 6,598,908 | B1 * | 7/2003 | Wosik | F16L 19/055 285/332.3 |
| 7,588,253 | B2 * | 9/2009 | Bottura | F16L 41/10 277/609 |
| 8,728,213 | B2 * | 5/2014 | Elwell | B01D 63/106 96/4 |
| 9,541,025 | B2 * | 1/2017 | Tadano | F16J 15/062 |
| 2011/0068543 | A1 * | 3/2011 | Bucknell | B25B 29/02 277/641 |
| 2017/0089473 | A1 * | 3/2017 | Nowell | F16K 5/0485 |

* cited by examiner

*Primary Examiner* — Gilbert Y Lee

(57) ABSTRACT

A sealed nut assembly includes a nut portion and a plug portion integrally formed together as a single unit. The nut assembly is configured to seal a bore hole in a fluid end and prevent leakage of working fluid therein. The assembly includes a nut portion and a plug portion. The nut portion and plug portion are inserted and removed together. The nut portion engages the fluid end prior to the setting of the plug portion. A seal groove is included in the plug portion to locate one or more seals. The contact surface between the nut assembly and the fluid end is tapered.

18 Claims, 6 Drawing Sheets

FRAC PUMP SEALED NUT ASSEMBLY

CLAIM OF PRIORITY

This application claims the benefit of U.S. Provisional Application No. 62/486,808 filed 18 Apr. 2017. The information contained therein is hereby incorporated by reference.

BACKGROUND

1. Field of the Invention

The present application relates generally to a reciprocating pump, and in particular to a combined nut and plug assembly for use in a fluid end assembly.

2. Description of Related Art

Hydraulic fracturing can increase the rate of production of oil and gas from low-permeability reservoirs. Hydraulic fracturing increases the permeability of reservoir rocks by opening channels through which oil and gas can travel to recovery wells. During hydraulic fracturing, a fluid is pumped through a wellbore under high pressure into a subterranean reservoir where it splits or fractures the reservoir rock. A proppant, like sand, is often added to the pumped fracture fluid and carried in suspension into the newly formed fractures. When pumping ceases, the fractures partially close on the proppant, leaving open channels for oil and gas to flow to the recovery well, i.e., the wellbore through which the fracture fluid was originally pumped.

High-pressure pumps are used to complete hydraulic fracturing procedures or "frac jobs." These pumps have "fluid ends" within which a number of reciprocating plungers pressurize the fracture fluid. As seen in FIGS. 1 and 2, the plungers reciprocate through a central channel typically between the suction valve and the discharge valve. At the end of the channel is a plug that is held firm to the body of the fluid end via interference fit. A separate nut is tightened behind the plug to ensure that the plug does not become dislodged or detached from the body of the fluid end. Within the channel are high levels of alternating pressures.

As seen in FIG. 1 of the drawings, a side section view of a traditional fluid end is illustrated. The fluid end includes a nut and a separate plug between the two valves and in line with the plunger. The plunger may be removed through the space occupied by the plug and nut. A number of issues can arise with conventional nut and plug assemblies. Plugs are typically press fit into a bore in the body of the fluid end. Once located, the nut is then threaded into position outside of the plug. An enlarged side section view is seen in FIG. 2 of the drawings. During installation of the plug, a user must apply a concentric force to allow the plug to seat properly. This is difficult to do as pressures can be high. Misaligned pressures can mar the bore in the fluid end, damage the plug, or even create a lack of sealing.

As fluid ends tend to need repair and maintenance at regular intervals, during repair and maintenance the fluid end has to be opened up to be cleaned and repaired. To do this, the nut has to be removed to allow the plunger to be withdrawn. Once the nut is threaded out, the plug is to be removed. Since the plugs are typically press fit into the fluid end body, a user is required to bang or hammer against the plug to break it loose from the fluid end. This can result in damage to the plug and bore. In general, this approach causes more labor costs and longer service times.

Another disadvantage of traditional plugs is that they typically only include a single seal which is directly exposed to the harsh contaminants in the fracture fluid. The seal wears quickly and tends to leak, especially given the levels of pressure experienced within the fluid end.

Although great strides have been made with respect to plugs and nuts in fluid ends, considerable shortcomings remain. An improved nut assembly is needed to mitigate damage from the contaminants in the fracture fluid and provide a simpler method of removal. Additionally the nut assembly needs to better provide for a properly aligned plug in a controlled manner.

SUMMARY OF THE INVENTION

It is an object of the present application to provide a nut assembly for use in a fluid end that combines into a single unit the functions of the plug and the nut. In this embodiment, the threaded nut is used to locate, remove, and install the plug. The threaded nut portion is configured to engage the threads prior to the plug engaging the fluid end so as to ensure proper alignment of the nut assembly. Proper force application is ensured as rotation of the nut portion acts to translate the plug portion into the bore of the fluid end. Removal is simplified as the plug portion is pulled from the bore of the fluid end at the time the nut is removed. The plug portion is withdrawn prior to the threads disengaging. Ultimately the invention may take many embodiments. In this way, this assembly overcomes the disadvantages inherent in the prior art.

The more important features of the assembly have thus been outlined in order that the more detailed description that follows may be better understood and to ensure that the present contribution to the art is appreciated. Additional features of the system will be described hereinafter and will form the subject matter of the claims that follow.

Many objects of the present assembly will appear from the following description and appended claims, reference being made to the accompanying drawings forming a part of this specification wherein like reference characters designate corresponding parts in the several views.

Before explaining at least one embodiment of the system in detail, it is to be understood that the assembly is not limited in its application to the details of construction and the arrangements of the components set forth in the following description or illustrated in the drawings. The assembly is capable of other embodiments and of being practiced and carried out in various ways. Also it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the various purposes of the present system. It is important, therefore, that the claims be regarded as including such equivalent constructions insofar as they do not depart from the spirit and scope of the present system.

DESCRIPTION OF THE DRAWINGS

The novel features believed characteristic of the application are set forth in the appended claims. However, the application itself, as well as a preferred mode of use, and further objectives and advantages thereof, will best be understood by reference to the following detailed description when read in conjunction with the accompanying drawings, wherein:

Figure 1:
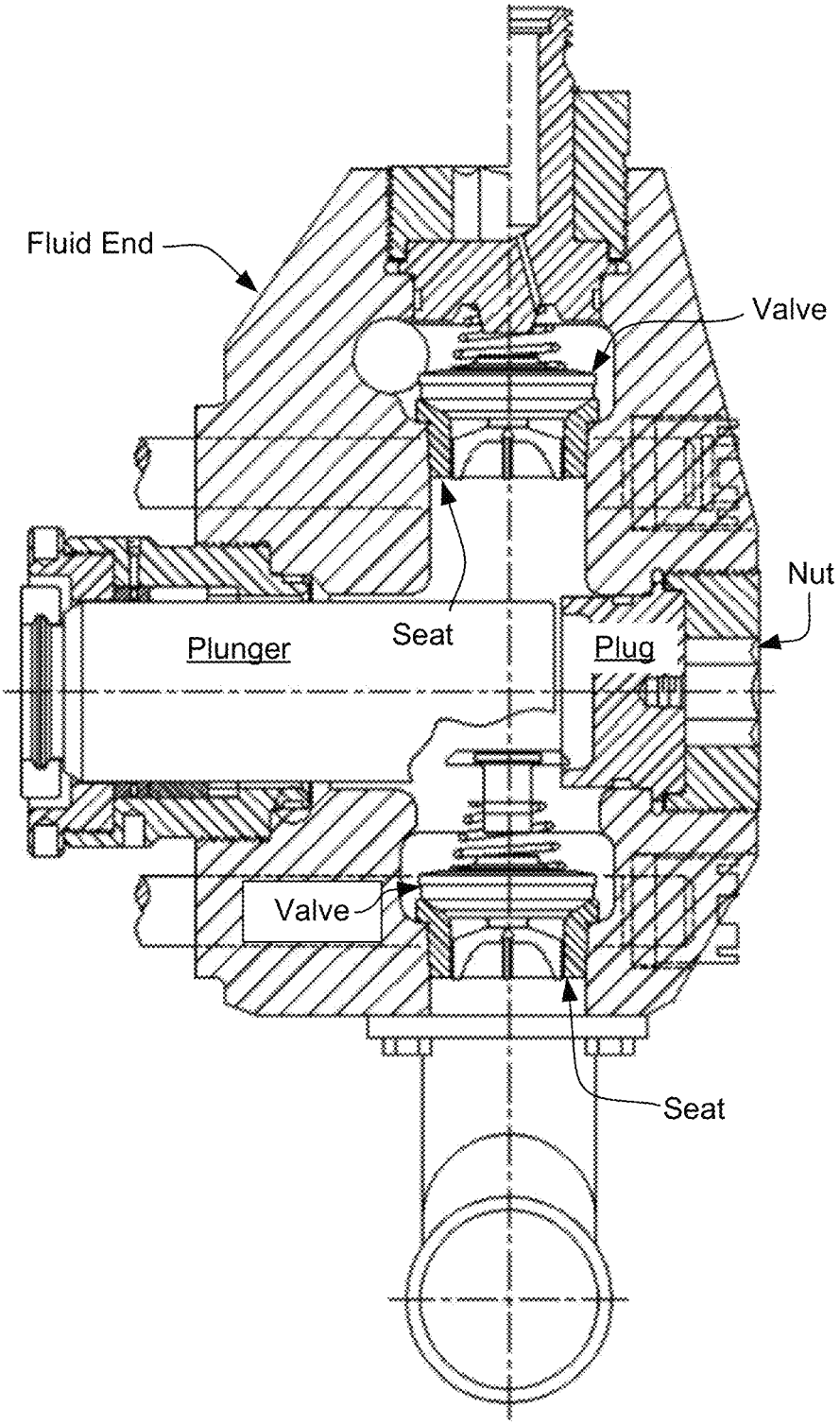
FIG. 1 (Prior Art)
FIG. 1 is a fragmentary perspective view showing a conventional fluid end assembly.

While the assembly and method of the present application is susceptible to various modifications and alternative forms, specific embodiments thereof have been shown by way of example in the drawings and are herein described in detail. It should be understood, however, that the description herein of specific embodiments is not intended to limit the application to the particular embodiment disclosed, but on the contrary, the intention is to cover all modifications, equivalents, and alternatives falling within the spirit and scope of the process of the present application as defined by the appended claims.

DETAILED DESCRIPTION OF THE PREFERRED EMBODIMENT

Illustrative embodiments of the preferred embodiment are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

In the specification, reference may be made to the spatial relationships between various components and to the spatial orientation of various aspects of components as the devices are depicted in the attached drawings. However, as will be recognized by those skilled in the art after a complete reading of the present application, the devices, members, apparatuses, etc. described herein may be positioned in any desired orientation. Thus, the use of terms to describe a spatial relationship between various components or to describe the spatial orientation of aspects of such components should be understood to describe a relative relationship between the components or a spatial orientation of aspects of such components, respectively, as the assembly described herein may be oriented in any desired direction.

The assembly in accordance with the present application overcomes one or more of the above-discussed problems commonly associated with conventional plugs in fluid ends. Specifically, the sealed nut assembly of the present application is configured to simplify the removal process of the plug and provide quicker access to the inside of the plunger channel. The nut assembly is a combination of a plug portion and a nut portion such that the plug is now inserted and removed via threaded communication between the nut and the fluid end. Additionally, the sealed nut assembly of the present application is configured to include one or more seals so as to increase longevity and the capability to prevent leaks. It is important to note that the nut assembly of the present application can be used on other portions of a fluid end and not just in line with the plunger stroke or other applications with this configuration. These and other unique features of the device are discussed below and illustrated in the accompanying drawings.

The assembly and method will be understood, both as to its structure and operation, from the accompanying drawings, taken in conjunction with the accompanying description. Several embodiments of the assembly may be presented herein. It should be understood that various components, parts, and features of the different embodiments may be combined together and/or interchanged with one another, all of which are within the scope of the present application, even though not all variations and particular embodiments are shown in the drawings. It should also be understood that the mixing and matching of features, elements, and/or functions between various embodiments is expressly contemplated herein so that one of ordinary skill in the art would appreciate from this disclosure that the features, elements, and/or functions of one embodiment may be incorporated into another embodiment as appropriate, unless otherwise described.

The assembly and method of the present application is illustrated in the associated drawings. The assembly includes a singular combined nut assembly having a nut portion and a plug portion. The plug portion includes a plurality of grooves for the use of one or more seals. The seals contact the bore of the fluid end to create a seal. The nut portion is configured to threadedly engage the fluid end and press the plug portion into place as the nut portion is rotated. The threads of the nut portion engage the fluid end prior to the plug portion engaging the fluid end bore to ensure that the plug portion enters in proper alignment. Additional features and functions of the device are illustrated and discussed below.

Referring now to the Figures wherein like reference characters identify corresponding or similar elements in form and function throughout the several views. The following Figures describe the assembly of the present application and its associated features. With reference now to the Figures, an embodiment of the modular observation assembly and method of use are herein described. It should be noted that the articles "a", "an", and "the", as used in this specification, include plural referents unless the content clearly dictates otherwise.

Figure 2:
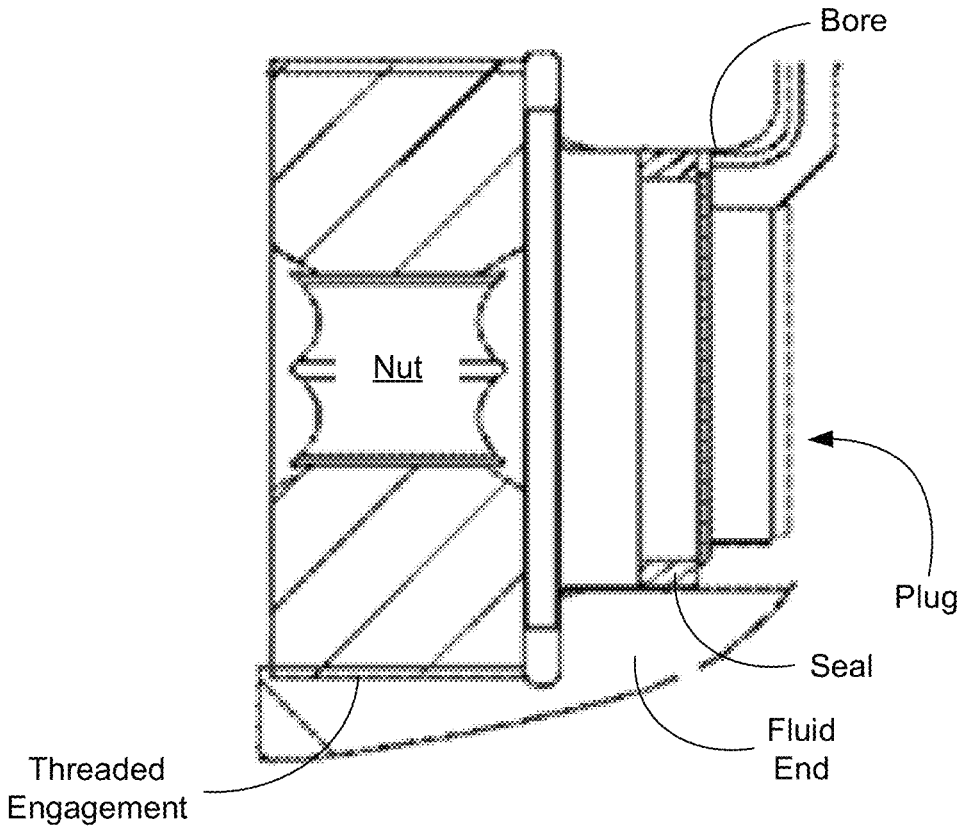
FIG. 2 (Prior Art)
FIG. 2 is an enlarged side view of an exemplary conventional nut and plug assembly for use in the fluid end of FIG. 1.
Figure 3:
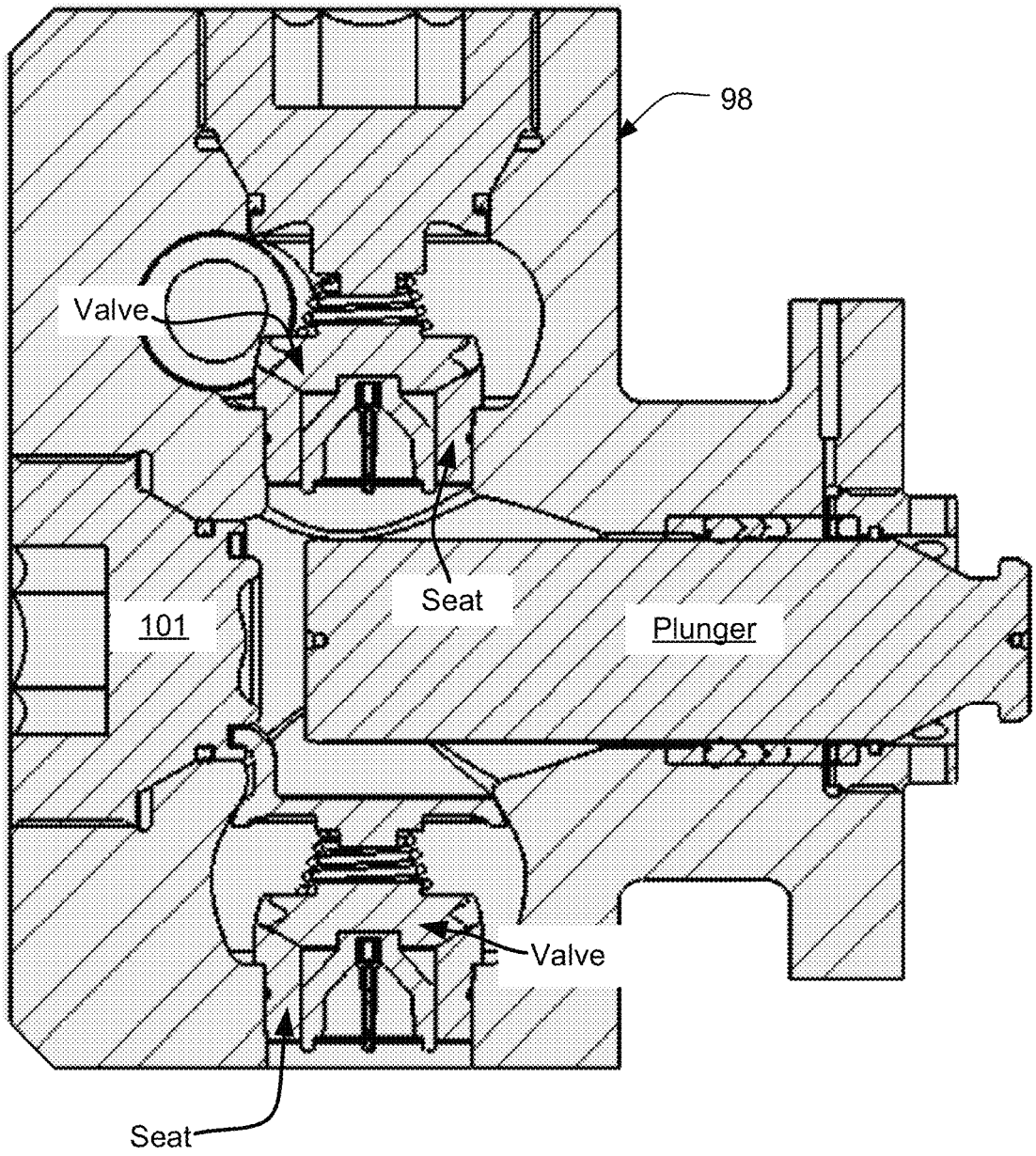
FIG. 3 is a side section view of an exemplary fluid end with a sealed nut assembly according to an embodiment of the present application.

Referring now to FIG. 3 in the drawings, a side section view of an exemplary fluid end with a sealed nut assembly according to an embodiment of the present application is illustrated. Sealed nut assembly 101 is designed to facilitate the operational functions of existing separate plugs and nuts used in fluid ends as seen with FIGS. 1 and 2. In fluid end 98, the plunger reciprocates within its channel causing the opposing valves to actuate opposite from one another. The valves make contact with its respective valve seat. Nut assembly 101 is aligned with the plunger between the opposing valves and seats. As pressure levels alternate within fluid end 98, nut assembly 101 is configured to plug and seal the fluid end bore opening.

Nut assembly 101 is a single unit with the nut and plug combined into a single integral part. Of particular note are some clear advantages to using a single part unit. First, the nut portion 103 and plug portion 105 can be removed by the user in a single step rather than multiple steps and the use of excessive force. Mere rotation of the nut portion 103 about its threads when engaged with the fluid end bore threads axially drives or withdraws plug portion 105 into/from its bore. Additionally, the engagement of the threads of nut portion 103 before the one or more seals engage with the bore allows the thread torque motion to engage properly to provide proper alignment prior to setting the one or more seals into place. Additionally, in reverse, the backing out of the thread disengages the thread and makes auxiliary tooling redundant.

Figure 4:
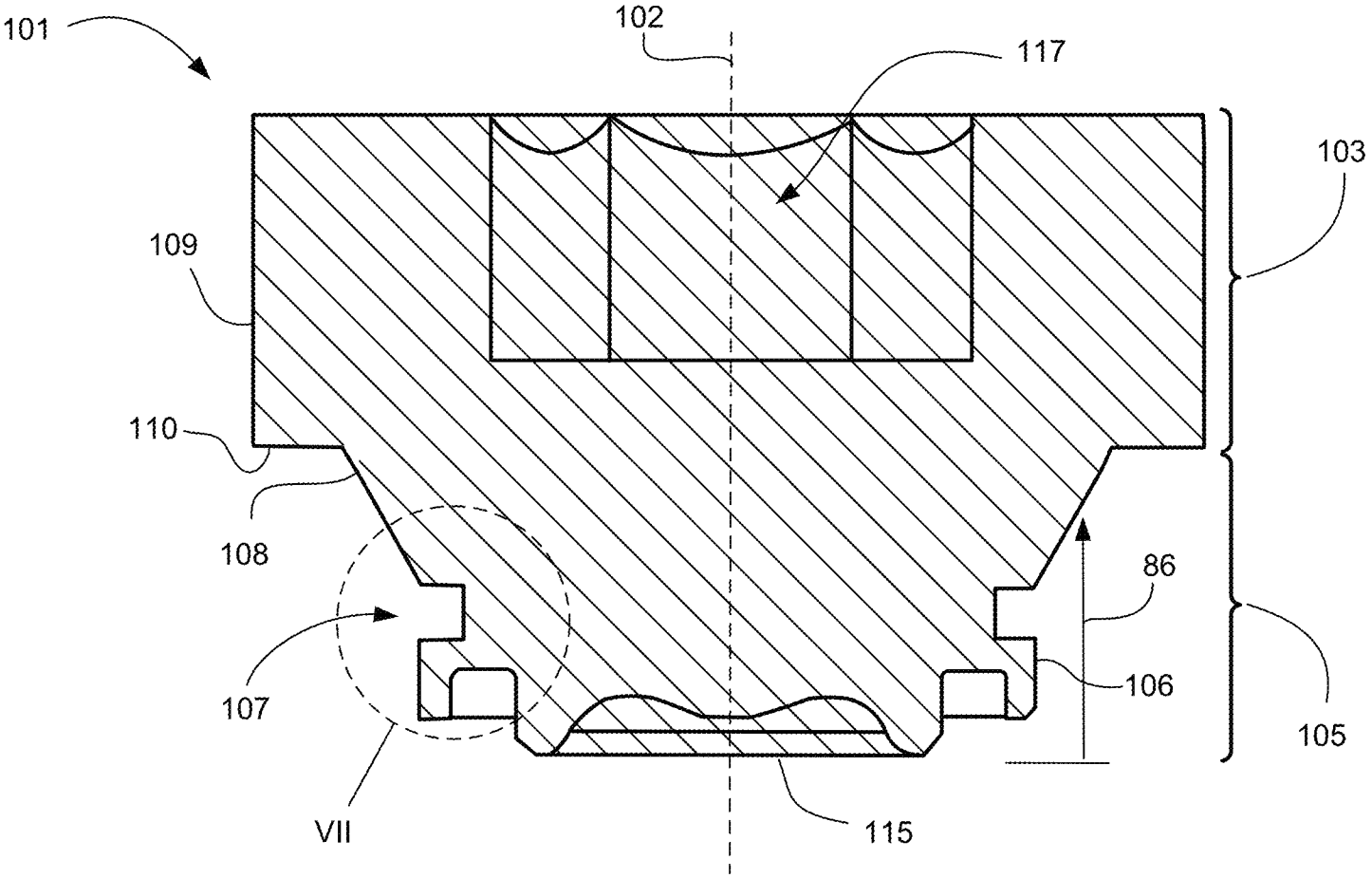
FIG. 4 is a side section view of the sealed nut assembly of FIG. 3.
Figure 5:
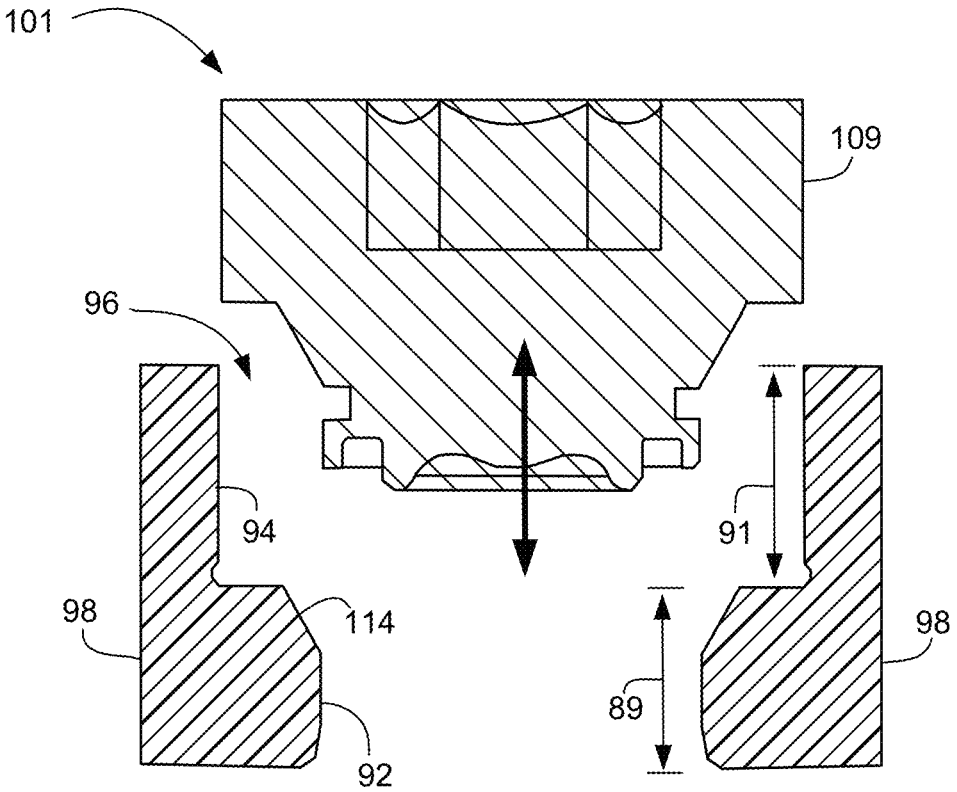
FIG. 5 is a side section view of the sealed nut assembly of FIG. 3 outside a fluid end bore.
Figure 6:
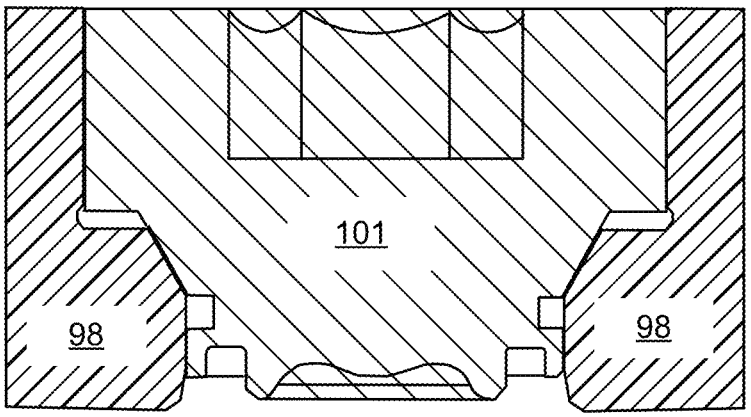
FIG. 6 is a side section view of the sealed nut assembly of FIG. 4 with the sealed nut assembly seated in the fluid end bore.

Referring now also to FIGS. 4-6 in the drawings, various side section views of nut assembly 101 is illustrated. Nut assembly 101 includes a nut portion 103 and a plug portion 105, as noted above. Nut portion 103 has a threaded attachment surface 109 and a drive feature 117. Plug portion 105 extends downward from a lower surface 110 of nut portion 103 to a lower plug surface 115. Plug portion 105 further includes a side surface 106 and a contact surface 108. The contact surface 108 extends between the lower surface 110 and the side surface 106.

Nut assembly 101 further includes one or more seal grooves 107 located in side surface 106. Seal grooves 107 are configured to locate the one or more seals. The one or more seals are configured to prevent leakage to the contact surface 108 from fluid within the fluid end 98. A single seal groove is shown in FIG. 4.

As seen in FIGS. 5 and 6, nut assembly 101 is illustrated relative to a portion of fluid end 98. Fluid end 98 is depicted to have a fluid end bore 96 sized to house nut assembly 101. Bore 96 is segregated into a nut bore 94 and a plug bore 92. Nut portion 103 is located in nut bore 94 when fully seated and plug portion 105 is located in plug bore 92 when fully seated (See FIG. 6). Nut bore has a height 91 and plug bore has a height 89. Nut bore 94 includes mating threads for engagement with surface 109 of assembly 101. Drive feature 117 is configured engage a tool to permit the application of a torque to assembly 101. This applied torque traverses assembly 101 into and out of the fluid end via threaded engagement between surface 109 and bore 94. The direction of rotation determines whether nut assembly 101 translates into or out of fluid end 98. It is important to note that as plug portion 105 and nut portion 103 are integrally formed together as a single unit, plug portion 105 of the assembly can be removed simultaneously with that of the nut portion 103 of the assembly 101.

During installation, nut assembly 101 is inserted into nut bore 94. Threaded engagement between surface 109 and bore 94 occurs prior to the contact of the one or more seals and/or plug portion in bore 92. As nut assembly 101 is threaded in bore 94, the alignment of nut portion 103 in bore 94 is configured to align plug portion 105 within bore 92. Further rotation of assembly 101 then causes plug portion to engage with and eventually set within bore 92. In order to accomplish the function of threaded engagement prior to contacting or setting of plug portion 105, the height 86 of plug portion 105 at any given location along contact surface 108 is less than nut bore height 91. The height 86 being measured from surface 115.

Contact surface 108 is configured to contact bore surface 114. Contact surface 108 is tapered from lower surface 110 to side surface 106, such that contact surface 108 provides the one or more seals with a zero extrusion gap. Contact surface 108 is non-perpendicular to nut axis 102. Side surface 106 is parallel to surface 109 and is configured to translate adjacent the interior wall surface of bore 92. The one or more seals in seal groove 107 are configured to press against bore 92 and create a seal to prevent leakage.

Figure 7A:
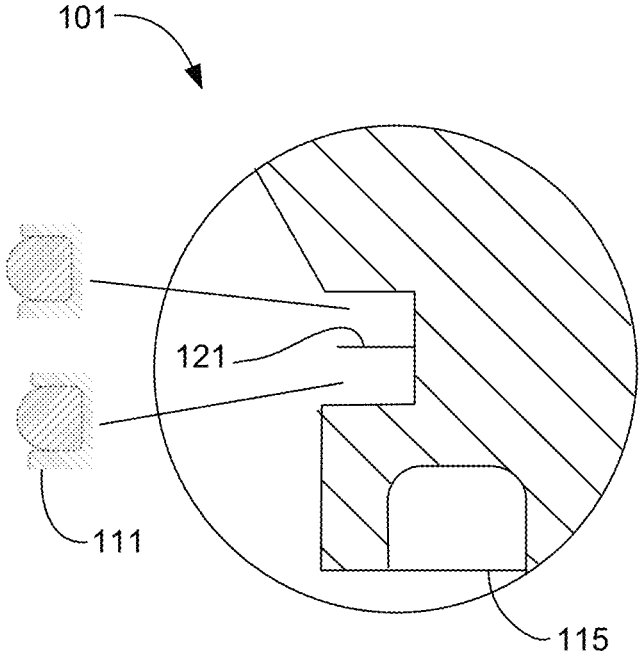
FIG. 7A-7B are enlarged partial side views of exemplary embodiments of a seal groove in the sealed nut assembly of FIG. 4.
Figure 7B:
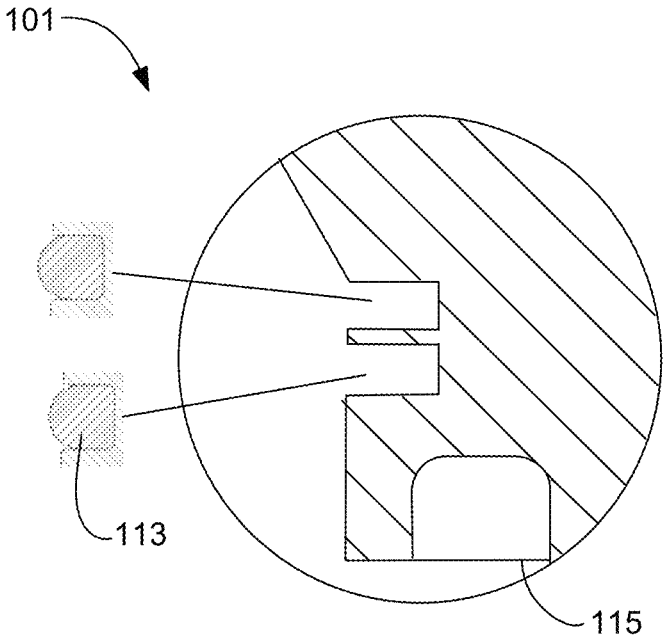

Referring now also to FIGS. 7A-7B in the drawings, enlarged side section views of seal grooves 107 are illustrated. In FIGS. 3-6, assembly 101 has been depicted with a singular groove 107 configured to hold any number of seals. In both figures, groove 107 is divided or segregated into at least two channels or grooves so as to contain a plurality of seals. As seen in FIG. 7A, seal groove 107 may be configured to have a ring 121 that separates the two seals 111. Ring 121 is configured to segregate groove 107 into a plurality of channels. One or more rings 121 may be used. Seals 111 extend around the circumference of surface 106. As seen in FIG. 7B, two distinct grooves 107 are used. Seals 113 are located in each groove 107. Surface 106 and bore 92 are directly exposed to the fracture fluid and pressures created by the plunger. Seals 111/113 (i.e. a primary seal) are configured to withstand pressure spikes and contaminants within the channel of the plunger in the fluid end. Seals 111/113 are configured to withstand full pressure of the system and are used to seal against any fluid loss and leakage. By using a dual seal configuration, assembly 101 is designed to prevent leaks that commonly form through a single sealed plug.

It is understood that any surface of assembly 101 may be treated with a coating, such as an anti-galling coating, or heat treated to give a harder surface than the mating face of the fluid end.

The current application has many advantages over the prior art including at least the following: (1) single unit; (2) ease of assembly into the fluid end as the threaded surface engages prior to the seal contacting the fluid end; (3) eliminating the need for extraction tools such as slide hammers and cranks; and (4) a zero extrusion gap.

The particular embodiments disclosed above are illustrative only, as the application may be modified and practiced in different but equivalent manners apparent to those skilled in the art having the benefit of the teachings herein. It is therefore evident that the particular embodiments disclosed above may be altered or modified, and all such variations are considered within the scope and spirit of the application. Accordingly, the protection sought herein is as set forth in the description. It is apparent that an application with significant advantages has been described and illustrated. Although the present application is shown in a limited number of forms, it is not limited to just these forms, but is amenable to various changes and modifications without departing from the spirit thereof.

What is claimed is:

1. A hydraulic fracturing pump nut assembly, comprising:

a nut portion defined along a nut axis and having a threaded attachment surface and a drive feature;

a plug portion extending along the nut axis from a lower surface of the nut portion to a lower plug surface, the plug portion including a side surface substantially parallel with the nut axis and a contact surface extending between the lower surface of the nut portion and the side surface and angled relative to the nut axis; and a groove formed along the side surface, wherein the contact surface extends to the groove;

wherein the nut portion and the plug portion are integrally formed as a unitary, single piece nut formed of the same material; and wherein the drive feature is integrally formed in the nut portion.

2. The assembly of claim 1, wherein the contact surface is tapered from the lower surface of the nut portion to the side surface of the plug portion.

3. The assembly of claim 2, wherein the tapered contact surface provides the seal a zero extrusion gap.

4. The assembly of claim 1, wherein the contact surface is non-perpendicular to a nut axis.

5. The assembly of claim 1, wherein the side surface is parallel to the threaded attachment surface.

6. The assembly of claim 1, wherein the groove is segregated into a plurality of channels.

7. The assembly of claim 1, further comprising:

a seal in the groove.

8. The assembly of claim 1, further comprising:

a first seal in the groove and a second seal located in a second groove, the second groove formed onto the side surface.

9. The assembly of claim 1, wherein the contact surface has an upper edge that intersects the lower surface of the nut portion; and wherein the contact surface ha a lower edged that extends to adjacent the groove.

10. The assembly of claim 1, wherein the groove has an upper edge closest to the nut portion and a lower edge closest to the lower surface of the plug portion; and wherein the contact surface extends to the upper edge of the groove.

11. The assembly of claim 1, wherein the contact surface is spaced apart along the lower surface of the nut portion from the threaded attachment surface.

12. A hydraulic fracturing pump nut assembly; comprising:

a nut portion defined along a nut axis and having a threaded attachment surface substantially parallel with the nut axis, with a drive feature formed in the nut portion about the nut axis;

a plug portion extending along the nut axis from a lower surface of the nut portion to a lower plug surface, the plug portion including a side surface substantially parallel with the nut axis and a contact surface having an upper edge and a lower edge and extending between the lower surface of the nut portion and the side surface and angled relative to the nut axis, wherein the contact surface upper edge intersects the lower surface of the nut portion at a location spaced apart from the threaded attachment surface; and a groove formed along the side surface of the plug portion, wherein the contact surface has a lower edged that intersects the groove;

wherein the nut portion and the plug portion are integrally formed ['together] as a unitary, single piece nut formed of the same material; and wherein the drive feature is integrally formed in the nut portion.

13. The assembly of claim 12, wherein the nut portion has a first diameter along which the threaded attachment surface is formed and the plug portion has a second diameter along which the side surface is formed; wherein the first diameter is greater than the second diameter.

14. The assembly of claim 12, wherein the upper edge of the contact surface extends from a third diameter, which third diameter is less than the first diameter and greater than the second diameter.

15. The assembly of claim 12, further comprising a seal disposed in the groove.

16. A hydraulic fracturing pump nut assembly, comprising:

a unitary nut comprising a nut portion defined along a nut axis and having a threaded attachment surface substantially parallel with the nut axis, with a drive feature formed in the nut portion about the nut axis;

a plug portion extending along the nut axis from a lower surface of the nut portion to a lower plug surface, the plug portion including a side surface substantially parallel with the nut axis and a contact surface having an upper edge and a lower edge, the contact surface extending from the lower surface of the nut portion; and a groove formed along the side surface of the plug portion, the groove having an upper edge closest to the nut portion and a lower edge closest to the lower surface of the plug portion;

wherein the lower edge of the contact surface extends to the upper edge of the groove;

wherein the nut portion and the plug portion are integrally formed as a unitary, single piece nut formed of the same material; and wherein the drive feature is integrally formed in the nut portion;

a fluid end having a fluid end bore formed in the fluid end and extending along a bore axis, the fluid end bore comprising a nut bore extending along a first length and of a first diameter along the first length and intersecting a plug bore extending along a second length and of a second diameter smaller than the first diameter with at least a portion of the nut bore being threaded; and a tapered bore surface formed at the intersection of the nut bore and plug bore.

17. The assembly of claim 16, wherein the contact surface is spaced apart along the lower surface of the nut portion from the threaded attachment surface.

18. The assembly of claim 16, further comprising a seal disposed in the groove.

* * * * *